US007367104B2

(12) United States Patent
Hohenbichler et al.

(10) Patent No.: US 7,367,104 B2
(45) Date of Patent: May 6, 2008

(54) METHOD AND DEVICE FOR THE PRODUCTION OF A TRIMMED METAL STRIP

(75) Inventors: Gerald Hohenbichler, Kronstorf (AT); Jean-Michel Damasse, Rueil Malmaison (FR)

(73) Assignee: Voest-Alpine Industrieanlagenbau GmbH & Co. (AT)

( * ) Notice: Subject to any disclaimer, the term of this patent is extended or adjusted under 35 U.S.C. 154(b) by 414 days.

(21) Appl. No.: 10/499,772

(22) PCT Filed: Dec. 18, 2002

(86) PCT No.: PCT/EP02/14467

§ 371 (c)(1),
(2), (4) Date: Sep. 24, 2004

(87) PCT Pub. No.: WO03/053612

PCT Pub. Date: Jul. 3, 2003

(65) Prior Publication Data

US 2005/0108868 A1 May 26, 2005

(30) Foreign Application Priority Data

Dec. 20, 2001 (FR) ..... 01 16601

(51) Int. Cl.
*B21B 1/46* (2006.01)
*B22D 11/12* (2006.01)

(52) U.S. Cl. ..... 29/527.6; 164/417; 164/418; 164/476

(58) Field of Classification Search .... 29/527.5–527.7; 164/476, 154.3, 452, 417, 486, 444, 70.1, 164/270.1, 418; 72/229, 234, 224; 148/551, 148/552, 644; 239/472, 494, 497
See application file for complete search history.

(56) References Cited

U.S. PATENT DOCUMENTS 3,149,520 A * 9/1964 Fish et al. ..... 83/288
3,196,531 A * 7/1965 Ripling ..... 228/104
3,333,452 A * 8/1967 Sendzimir ..... 72/184

(Continued)

FOREIGN PATENT DOCUMENTS

BE 832 557 12/1975

(Continued)

OTHER PUBLICATIONS

English equivalent of EP 0 698 433.

*Primary Examiner*—Jermie E. Cozart
*Assistant Examiner*—Alexander P Taousakis
(74) *Attorney, Agent, or Firm*—Ostrolenk, Faber, Gerb & Soffen, LLP

(57) ABSTRACT

The invention relates to a method for production of a metal strip from a strip (6), cast directly from molten metal (4), whereby a trimming of the strip edges (9, 9') of the strip (6) is carried out, characterised in that the strip edges (9, 9') are cooled before the trimming in such way as to render said edges more brittle than the rest of the strip (6). The invention further relates to a unit for processing a thin metal strip (6), arising from the casting of thin strips directly from molten metal, characterised in comprising a unit for the controlled, exclusive or preferential cooling of the strip edges (9, 9') of the strip (6).

9 Claims, 2 Drawing Sheets

U.S. PATENT DOCUMENTS 3,483,915 A * 12/1969 Thalman et al ..... 164/476
4,527,613 A 7/1985 Bedell et al.
4,555,921 A * 12/1985 Matsuda et al. ..... 72/224
4,658,882 A * 4/1987 Oba et al. ..... 164/417
4,958,677 A * 9/1990 Kimura ..... 164/452
5,065,811 A * 11/1991 Scholz et al. ..... 164/460
5,197,179 A * 3/1993 Sendzimir et al. ..... 29/527.4
5,584,335 A 12/1996 Barbe et al.
5,947,182 A * 9/1999 Nohara et al. ..... 164/417
6,044,895 A * 4/2000 Kuttner et al. ..... 164/155.4
6,216,770 B1 * 4/2001 Hensger et al. ..... 164/476
6,332,492 B1 * 12/2001 Donini et al. ..... 164/476

FOREIGN PATENT DOCUMENTS

BE 832 558 12/1975
DE 92 03 472 6/1992
EP 0 698 433 2/1996

* cited by examiner

METHOD AND DEVICE FOR THE PRODUCTION OF A TRIMMED METAL STRIP

BACKGROUND OF THE INVENTION

The invention relates to the continuous casting of metals, more specifically the casting of strips of small thickness directly from liquid metal.

The continuous casting of metal strips, in particular of strips made from carbon steel or stainless steel, with a thickness of a few mm, and preferably thicknesses of less than 10 mm, directly from liquid metal is well-known in the literature.

The casting of a metal strip is generally carried out on an installation for what is known as twin-roll casting. Installations of this type comprise as their main components, which form the permanent mold and in which the strip solidifies, two rolls with substantially horizontal axes which are arranged opposite one another and are driven in rotation in opposite directions about their respective axes. These rolls are strongly cooled on the inside, and their lateral surfaces define a casting mold with moveable walls, at which solidification of the strip in the form of two strand shells commences; these strand shells develop further starting from the roll surfaces. These stand shells converge so as to meet substantially at the "kissing point", i.e. the zone in which the surfaces of the rolls are closest together, with a distance between them which corresponds to the thickness of the desired strip, in order to form the strip which is drawn continuously out of the casting mold. The casting space is laterally delimited by two refractory walls which are placed against the flat ends of the rolls or are held at a very short distance therefrom, in order to avoid leakage of metal. This process is described in more detail, for example, in document EP-A 0 698 433.

It is also conceivable to produce thin metal strips by the liquid metal being applied to the rotating lateral surface of a single cooled casting roll on which the metal solidifies. This makes it possible to obtain a strip with a thickness which is generally less than that produced by casting between two rolls.

The strips cast using these processes are generally intended for cold-rolling in order to obtain metal sheets with standard thicknesses. They may previously also be subjected to hot-rolling, which is intended to alter microstructures and close up porosities which may form in the core of the strip as it solidifies. From an economic point of view, it is particularly advantageous for this hot-rolling to be carried out using a rolling stand which is positioned along the conveying path for the strip which has just been cast.

The strips cast in this way generally have to be subjected to strip-edge trimming to a width of approximately 15 mm before they are cold-rolled or also preferably before they are first coiled after casting. This is because these strip edges are formed from strand shell sections which have solidified under different conditions than those which have led to solidification of the more central parts of the strip, in particular on account of the proximity of the lateral closure walls, which have a tendency to cool the metal more quickly than normal. Possible differences between the cooling actions effected by the rolls between their edges and their more central parts may also occur. The cooling may be greater at the edges than in the center and vice versa, depending on the design of the rolls. These differences, which are often difficult to control during the solidification and cooling process between the edges and the remainder of the strip, often cause differences in the mechanical properties of the strip along its width. The metal sheets produced under these conditions may therefore have inhomogeneous properties, which needs to be avoided.

The strip edges may also be irregular in shape, which leads to inhomogeneities in the mechanical properties of the metal sheets during the subsequent rolling operations, in particular on account of the local differences in the degree of reduction obtained. On the other hand, if leaks of liquid metal occur between the casting rolls and the lateral closure walls, the strip edges become uneven, and this unevenness needs to be eliminated before the cold-rolling in order not to adversely affect the surface of the roll cylinders.

For all these reasons, the strip edges are trimmed at a given time during the processing of the strips, with the aid of trimming shears or any other tool which is conventionally used in installations for processing strips which have been produced by standard processes.

In principle, it is advantageous for the strip edges to be trimmed as early as possible, for example before the strip is coiled following its casting. If at this stage the edges are significantly warmer than the remainder of the strip, however, there is a risk of them having mechanical properties which make it more difficult for them to be completely separated from the strip by the shears, in particular if the width of the hot zone does not precisely correspond to the width of the edges which are to be cut. This problem may be exacerbated if hot-rolling of the strip prior to trimming of its edges is performed in one line. This is because this hot-rolling is often preceded by a step of reheating the strip in an induction furnace. During this reheating, the field lines tend to concentrate at the edges of the strips, which leads to temperatures at the edges which are higher than the temperatures prevailing at the remainder of the strip. This homogeneity persists after the hot-rolling and makes subsequent correct trimming of the strip edges difficult.

SUMMARY OF THE INVENTION

It is an object of the invention to propose a process and a device which allow satisfactory trimming of the strip edges to be carried out even if the strip edges are initially at a higher temperature than desirable.

For this purpose, the invention relates to a process for producing a metal strip from a strip which is cast directly from liquid metal and the strip edges of which are trimmed, characterized in that the strip edges are cooled in a controlled way, in order to make them more brittle than the remainder of the strip, before being trimmed.

This metal may be steel, and in this case the cooling of the strip edges begins at a temperature of from 950 to 1100° C.

The strip edges are preferably cut immediately after the controlled cooling thereof.

The strip edges may be trimmed before the strip is coiled.

The controlled cooling of the strip edges may be carried out after hot-rolling of the strip, which is itself preceded by reheating of the strip by inductive heating.

The controlled cooling of the strip edges is preferably carried out in-line with the casting of the strip.

The invention also relates to an installation for processing thin metal strips which come from an installation for casting thin strips directly from liquid metal, characterized in that it comprises an installation for the exclusive or preferential controlled cooling of the strip edges of the strip.

This installation for the controlled cooling of the strip edges of the strip may be arranged upstream of an installation for trimming the strip edges.

The installation for the controlled cooling of the strip edges of the strip may be arranged on the same processing line as the casting installation for thin strips.

The installation for the controlled cooling of the edges may comprise ramps with spray nozzles which each direct a jet of cooling fluid onto one side of a strip edge.

The ramps may be arranged above and below the strip, and the spray nozzles direct the jets onto the outer side of the strip.

The ramps may be arranged at the sides of the strip, with the spray nozzles directing the jets onto the narrow side of the strip, and the installation for the controlled cooling of the edges also comprises barriers which are in sliding contact with the strip surface and each delimit a section of the width of the strip edges which constitutes the area of action of the cooling fluid.

As has been explained, the invention consists in strong cooling of the edges of the strip before they are cut. This cooling is carried out by spraying a fluid onto a width which corresponds to the width of the region to be cut.

BRIEF DESCRIPTION OF THE DRAWINGS

The invention is made easier to understand by studying the following description, which does not restrict the invention and relates to the following appended figures, in which.

DESCRIPTION OF PREFERRED EMBODIMENTS

Figure 1A:
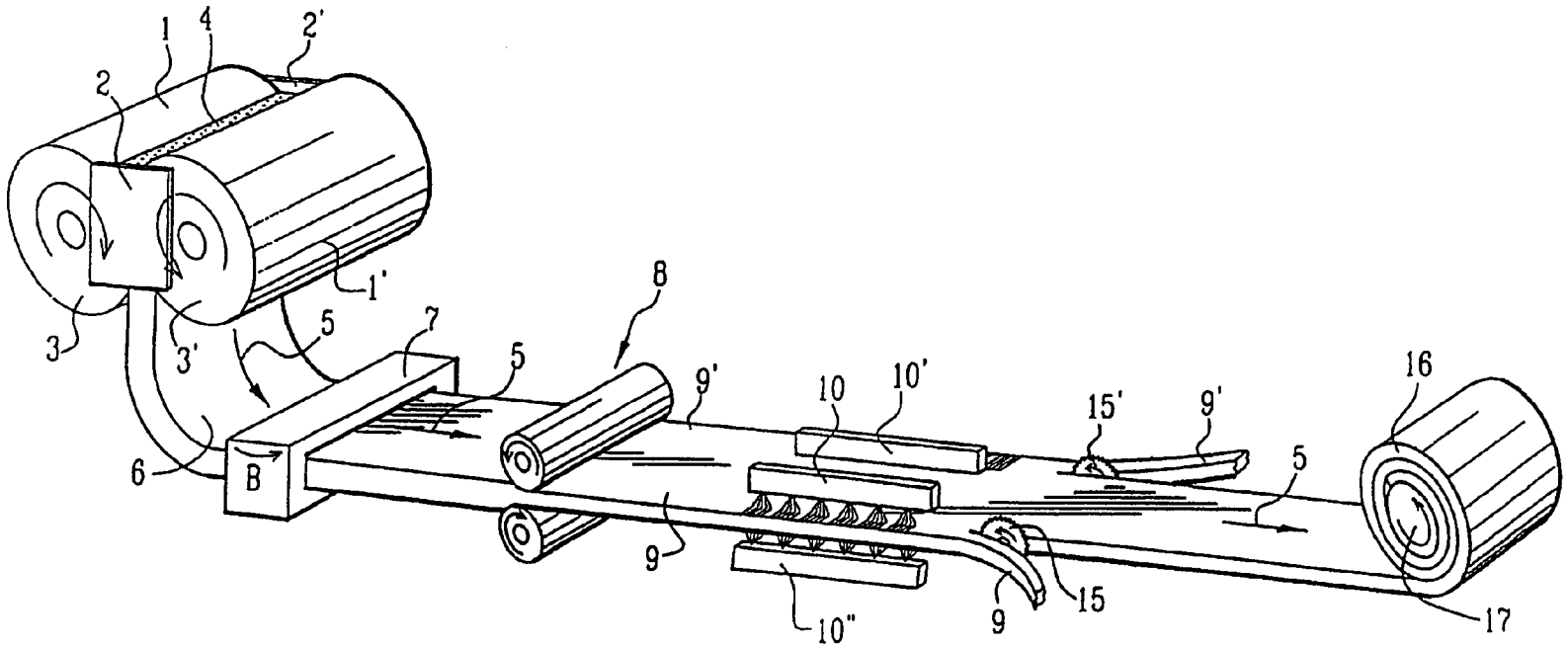
FIG. 1 diagrammatically depicts a perspective view (FIG. 1*a*) of a continuous casting installation for thin strips, which is provided with a device for trimming the strip edges, upstream of which there is an installation for cooling the strip edges (FIG. 1*b*)

The example of a casting installation for strips made from metal, in particular from steel, which is illustrated in FIG. 1*a*, conventionally comprises two casting rolls 1, 1', which are internally cooled and are driven in rotation in opposite directions about their axes in a horizontal position. Lateral closure walls 2, 2', which are fitted between the flat end sides 3, 3' of the rolls 1, 1', together with the side walls of the rolls 1, 1', delimit a casting space into which liquid steel is cast continuously by means (not shown) such as for example a refractory pipe which is connected to a tundish. In this way, a strip 6 is solidified and removed in the direction indicated by the arrow 5, with a thickness of generally 1 to 10 mm.

In the example illustrated, the strip 6 passes through an induction furnace 7 in a known way; the induction furnace is intended to reheat the strip before it enters a hot-rolling stand 8, which reduces the thickness of the strip 6 by, for example, 10% or more.

According to the invention, the strip edges 9, 9' of the strip 6 are then subjected to strong, controlled cooling, while the remainder of the strip 6 continues to cool naturally or under the effect of a significantly more moderate, controlled cooling.

The term "strip edges" 9, 9' of the strip 6 is to be understood as meaning sections which each extend from one of the lateral boundaries of the strip 6 over a width which may be up to 25 mm and are then cut off or trimmed in a step which precedes the cold-rolling of the strip 6.

In the example illustrated, this trimming is carried out immediately after the controlled cooling and prior to coiling of the strip 6.

Figure 1B:
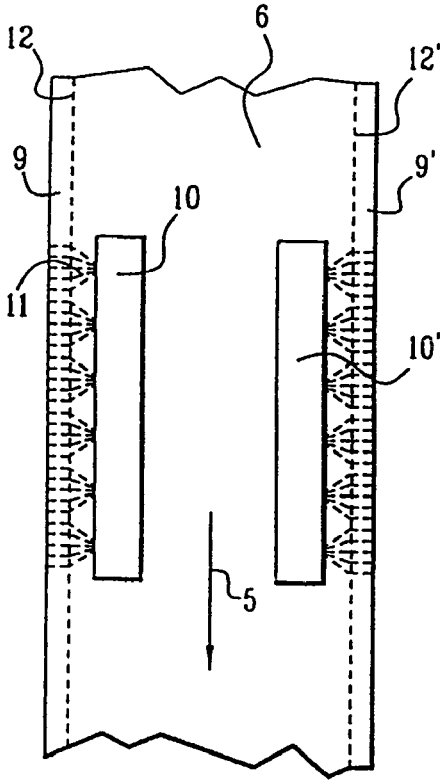

In the example illustrated in FIG. 1, the installation for the controlled cooling is formed by ramps 10, 10', 10" which comprise spray nozzles that each direct a jet 11 of a cooling fluid onto the strip 6. This fluid may, in a known way, be water, a water-air mixture, air, liquid nitrogen, etc., provided that it is sprayed on in sufficient quantity to obtain the desired cooling action at the strip edges 9, 9' of the strip 6. The ramps 10, 10', 10" are preferably present above and below each strip edge 9, 9', in order to cool both sides of each edge. Strictly speaking, to obtain identical cooling on both sides of each strip edge, it should be taken into account that the cooling fluid may run off the top side over the impingement region of the jet 11 which comes from a given spray nozzle, whereas runoff of this type is much more limited on the underside of the strip 6. If precisely symmetrical cooling of the strip edges 9, 9' is to be achieved on both sides of the strip 6, therefore, this phenomenon has to be compensated for, for example by more cooling fluid being sprayed onto the underside of the strip. This phenomenon is known from conventional continuous casting, and the person skilled in the art can use his standard knowledge and the mathematical models available for cooling of the strip, which he has available to him for the specific case of his casting installation, in order to remedy the problem.

In the example illustrated in FIG. 1, the ramps 10, 10', 10" spray fluid jets 11 which are directed onto the outside of the strip 6. This means that the fluid does not run off toward the central region of the strip 6, and consequently the cooling of the central region continues naturally. In this way, the action of the cooling is restricted to the strip edges 9, 9', which are indicated by dashed lines 12, 12'. This restricting of the location of the cooling action can be supplemented by all or part of the central region of the strip 6 which is not to be cooled being covered with one or more caps, this or these cap(s) being held at a short distance from the surface of the strip 6.

Figure 2:
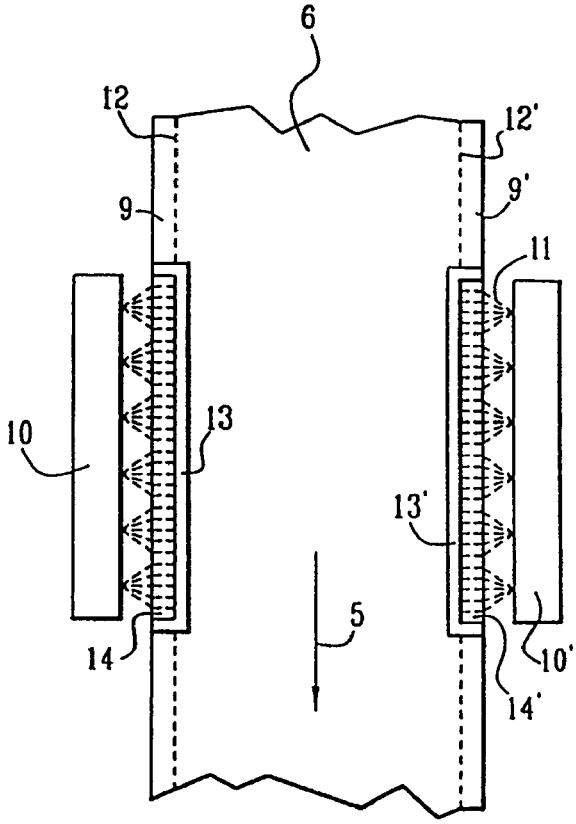
FIG. 2 shows a variant of the installation for cooling the strip edges.

In the variant illustrated in FIG. 2, the ramps 10, 10' are arranged at the side rather than above or below the strip 6 and spray their jets 11 of the cooling fluid onto the narrow side of the strip 6. The fluid is prevented from running off toward the central region of the strip by virtue of a barrier 13, 13' which strictly limits the area of action of the cooling fluid to a section 14, 14' of the length of the strip edges 9, 9', being arranged in sliding contact with the surface of the strip. This solution offers the advantage over the solution described above that the surface of the central region continues to remain clear, so that it can be observed more easily. Furthermore, the ramps 10, 10' are therefore located at a distance from the radiation emanating from the strip 6, and there is therefore no need for complex means for protecting or cooling them in order to prevent them from being adversely affected.

Following the installation for cooling the edges which has just been described, the strip passes through an installation for trimming the strip edges, which is formed by circular saws 15, 15' and preferably by circular blade shears, although it is, of course, possible to use any known device which is able to ensure this function at the outgoing strip 6. Devices of this type are generally known and are used in particular in rolling mill trains. Then, the strip 6 is wound up to form a coil 16 about a rotating coiler drum 17. The wound coil can then be conveyed to the installation which is responsible for further treatment of the strip 6, for example cold-rolling, annealing and pickling which precedes cold rolling, etc.

The accelerated cooling of the strip edges 9, 9, is intended to provide the strip edges with a metallurgical structure which represents a significant change compared to the structure of the remainder of the strip 6, this change being toward greater cohesion of the metal. The installation for trimming the strip edges requires a higher level of outlay for cutting to be carried out at this level than if the mechanical properties of the strip 6 were to be substantially homogeneous over its entire width. However, this increased outlay leads to a cleaner cut which does not require any subsequent deburring.

The installation according to the invention for cooling the strip edges of a thin strip which has been produced by continuous casting is not necessarily arranged in-line with the casting installation. It may be arranged at any location in the production line at which the temperature of the strip is greater than 950° C., so that the desired metallurgical action for this cooling is obtained. Moreover, it is not always necessary for the installation 15, 15' for cutting the strip edges 9, 9' to immediately follow the cooling installation in accordance with the invention, except if this cooling would be ineffective as a result of there being a risk of the strip edges 9, 9' fracturing spontaneously during processing of the strip 6 before the strip edges 9, 9' are cut off. An uncontrollable, spontaneous fracture may cause danger to the operating staff and equipment if it occurs at a location which is not intended to receive the cut strip edges 9, 9'. A further advantage of the cooling and cutting directly following one another is that the strip edges 9, 9' therefore do not have time to heat up again under the action of the heat emanating from the remainder of the strip 6. Renewed heating of this nature could return the edges 9, 9' to a metallurgical structure and mechanical properties which are closer to those of the remainder of the strip 6, which would reduce the effect of the cooling of the edges and also the cut quality.

As a variant, the step of cooling the strip edges 9, 9' may coincide with a step of controlled cooling of the entire strip 6 for metallurgical reasons. In this case, during this step significantly greater cooling is to be performed at the strip edges 9, 9' than at the remainder of the strip 6 in order for the invention to be deployed. Therefore, this variant no longer represents exclusive cooling, but rather just preferential cooling of the strip edges 9, 9'.

The situation which has just been described arises in the case of a strip 6 which is cast between rolls, but it will be understood that the invention can also be employed if the thin strip 6 has been cast by means of a different process. The process according to the invention can also be applied to metals other than steel, provided that they are able to be cast directly to form a thin strip, such as for example aluminum, copper and alloys thereof.

The invention claimed is:

1. A process for producing a metal strip comprising:

casting a strip directly from liquid metal, the liquid metal being steel and the cast strip having edges; exclusively cooling the strip edges from a pre-cooling temperature in a range from 950° C. to 1100° C. in a controlled way without a controlled cooling of a remainder of the strip between the edges to make the edges more brittle than the remainder of the strip, and trimming the more brittle strip edges immediately after the exclusive controlled cooling of the strip edges, while the remainder of the strip remains substantially at the pre-cooling temperature.

2. The process as claimed in claim 1, further comprising coiling the strip after the strip edges are trimmed.

3. The process as claimed in claim 1, further comprising: prior to the step of exclusively cooling the strip edges in the controlled way, reheating the strip by inductive heating, and hot rolling the strip.

4. The process as claimed in claim 1, wherein the controlled cooling of the strip edges is carried out in-line with the casting of the strip.

5. An installation for processing a thin metal strip comprising:

a first installation operable to cast thin strips directly from liquid metal, the liquid metal being steel and the cast strip having edges; a second installation following the first installation, the second installation being operable to controllably cool exclusively the strip edges of the cast strip from a pre-cooling temperature in a range from 950° C. to 1100° C. without a controlled cooling of a remainder of the cast strip between the edges, and a third installation following the second installation, the third installation being operable to trim the strip edges immediately after the second installation controllably cools exclusively the strip edges, while the remainder of the strip remains substantially at the pre-cooling temperature.

6. The installation as claimed in claim 5, further comprising a processing line in the installation, wherein the second installation for the controlled cooling of the strip edges of the strip and the first casting installation for thin strips are arranged on the same processing line.

7. The installation as claimed in claim 5, wherein the second installation for the controlled cooling of the strip edges comprises ramps and spray nozzles which each direct a jet of a cooling fluid onto one side of a strip edge of the strip.

8. The installation as claimed in claim 7, wherein the ramps are arranged above and below the strip, and the spray nozzles are positioned to direct the respective jets onto an outer side of the strip.

9. The installation as claimed in claim 7, wherein the strip has narrow sides, the ramps are arranged at the sides of the strip, and the spray nozzles are positioned to direct the jets onto the narrow sides of the strip; and wherein the second installation for the controlled cooling of the strip edges also comprises barriers which are in sliding contact with the surface of the strip each barrier delimits a section of the width of the strip edges of the strip which constitutes an area of action of the cooling fluid.

* * * * *